US006371417B1

(12) United States Patent
Southon

(10) Patent No.: US 6,371,417 B1
(45) Date of Patent: Apr. 16, 2002

(54) RAILWAY WHEEL COUNTER AND BLOCK CONTROL SYSTEMS

(75) Inventor: Brian Neil Southon, Oakville (CA)

(73) Assignee: L.B. Foster Company A. Pennsylvania Corp., Pittsburgh, PA (US)

( * ) Notice: Subject to any disclaimer, the term of this patent is extended or adjusted under 35 U.S.C. 154(b) by 0 days.

(21) Appl. No.: 09/486,947

(22) PCT Filed: Sep. 4, 1998

(86) PCT No.: PCT/CA98/00867

§ 371 Date: May 22, 2000

§ 102(e) Date: May 22, 2000

(87) PCT Pub. No.: WO99/11497

PCT Pub. Date: Mar. 11, 1999

Related U.S. Application Data

(60) Provisional application No. 60/064,862, filed on Sep. 4, 1997.

(51) Int. Cl.[7] ..... B61L 11/00

(52) U.S. Cl. ..... 246/247; 246/249; 246/112 R

(58) Field of Search ..... 246/122 R, 124, 246/247, 249, 270 R, 359, 360, 473 R, 478, 246; 324/200, 207.13, 207.15, 207.16, 207.22, 225, 257, 259, 179

(56) References Cited

U.S. PATENT DOCUMENTS

| | | | | | |
|---|---|---|---|---|---|
| 3,567,920 | A | * | 3/1971 | Campbell | 246/249 |
| 3,697,745 | A | * | 10/1972 | Bolton | 246/249 |
| 3,721,821 | A | * | 3/1973 | Blanyer | 246/249 |
| 3,941,338 | A | | 3/1976 | Knudsen | |
| RE30,012 | E | * | 5/1979 | Wikas et al. | 246/247 |
| 4,283,031 | A | * | 8/1981 | Finch | 246/128 |
| 4,524,932 | A | * | 6/1985 | Bodziak | 246/247 |
| 5,333,820 | A | * | 8/1994 | Gilcher | 246/249 |
| 5,395,078 | A | | 3/1995 | Gellender | |
| 5,628,479 | A | | 5/1997 | Ballinger | |
| 6,043,774 | A | * | 3/2000 | Singh et al. | 342/127 |

FOREIGN PATENT DOCUMENTS

| | | |
|---|---|---|
| DE | 3643970 | 6/1988 |
| DE | 3808484 | 9/1989 |
| EP | 0002609 | 6/1979 |
| FR | 2494655 | 5/1982 |

* cited by examiner

*Primary Examiner*—Mark T. Le
(74) *Attorney, Agent, or Firm*—Dowell & Dowell, P.C.

(57) ABSTRACT

Railway wheel detection and counter and block control systems are disclosed using magnetic coils to detect wheels via measuring eddy current losses induced by a railway wheel as it disturbs the coil's magnetic field. Information from the coils is measured and processed using combination of analog and digital signal processing which processing automatically tests and calibrates all components to provide fail-safe operation. Virtual blocks are used to establish train presence, speed, and direction which parameters are used to provide block control systems.

24 Claims, 7 Drawing Sheets

RAILWAY WHEEL COUNTER AND BLOCK CONTROL SYSTEMS

This application claims benefit of Provisional Application Ser. No. 60/064,862, filed Sep. 4, 1997.

FIELD OF THE INVENTION

The present invention relates to monitoring railway trains, and in particular to a method and apparatus used to detect the presence, speed and direction of railway trains, and to count their wheels, and measure their wheel radius and wheel flange depth.

BACKGROUND OF THE INVENTION

The prior art has developed a variety of transmitter and receiver coil configuration for sensing the presence of a train wheel. Some of these are subject to errors and inaccuracies due to debris near the coils, temperature drift and component aging. Also interconnecting cables and even drift and variations in the signal processing electronics makes it difficult to guarantee the accurate detect all wheels.

Other prior art systems (Gilcher, Patent 5,333,820) use a single transmitter and a dual receiver coils in a differential bridge circuit that compensates somewhat for drift and some disturbances from debris and thermal drift. This system requires coils be mounted on both sides of the rail and require a precise balance in signal strength and a critical field adjustment to run the system at a slight imbalance in order to derive a small carrier signal. There is no adjustments for long term drift and no automatic adjustments. The use of a potentiometer to adjust the unit requires a field operation and is also subject to mechanical vibration, humidity and corrosion of the potentiometer which can lead to an undetectable error. There is also no method to automatically test that the sensor is actually operational. Hence, failure to detect a wheel is not known until a wheel passes the sensor and fails to cause the desired actions. (This circuit is hence, not vital.)

In the past, wheel sensing of variety detection means including photo-electrics, mechanical switches, load sensing, proximity switch technologies and magnetic disturbance measuring devices. All of these existing devices lack one or more of the requirements for vital railway applications, ie., critical life-preserving and accident prevention situations. These requirements are:

- Reliable operation over extended temperature ranges.
- Relative immunity to environmental conditions such as ice, snow, fog, chemicals, corrosion and water.
- Ability to withstand intense vibration and mechanical shock generated by passing trains.
- "Zero speed" detection, ie: ability to detect a wheel even if it is moving dead-slow or stopped.
- Ability to determine direction of travel in a "fail-safe" manner.
- Ability to determine sensor removal from the rail regardless of the speed of removal of the sensor from the rail.
- Able to detect broken or shorted cables and defective drive electronics.

Traditional track circuits used in the railway industry employ electric currents in sections of rail separated by insulators in order to provide separate and distinct physical blocks. A differential voltage exists between the two rails when the block is not occupied by a train. When a train wheel and axles enter the block, a 'shunt' is provided which creates a change in the current and voltage which is detected by the controller. This shunting requires good electrical conductivity between the rail and the wheel, which is not always available and contributes to an unsafe condition where a train occupancy can be missed.

Traditional track circuits require that the ballast material, (e.g. the rock, gravel or slag comprising the roadbed), be non-conductive and that no other conductive material be placed between the rails. Contaminated ballast occurs frequently enough to be a serious safety hazard leading to false activation of the track circuits and/or missed train detection. The insulated joints needed to define track circuits are also troublesome, being very expensive to maintain. Furthermore, these track circuit usually indicate only occupancy and only the most complex control systems can measure the position of the train within a block.

Many alternatives to traditional track circuits have also been utilized. Photoelectric systems such as those disclosed in U.S. Pat. No. 3,581,083 to Joy will fail if snow blocks the light source. This makes them suitable only in warmer climates. Passive inductor systems such as those disclosed in U.S. Pat. No. 3,108,771 to Peling do not provide adequate signal output at low operating speeds and fail to detect slow trains. These systems cannot detect their own removal from the rail and hence are not "fail-safe".

SUMMARY OF THE INVENTION

A device and method of detecting the presence, the speed, direction and movement of a railway vehicle via eddy current losses induced in a train wheel as it comes into proximity of a high frequency magnetic field. The same coil is used to transmitting and receiving, increasing the reliability of the sensor. Only one side of the rail is equipped with the sensor which makes mounting easier. The single coil is automatically calibrated through a digital signal processor which adjusts automatically for all temperature, component aging and metallic debris situations as well as detecting sabotage and damaged sensors. The circuit is self calibrating and self testing such that the system can detect its own inability to detect a wheel before a wheel arrives and will enter a fail-safe state.

So testing is done by a innovative technique termed the slope test. The circuit operates at a point approximately midway on the frequency-voltage curve, and thence a purposeful incremental increase in the operating frequency can cause a slight increase in the voltage drop across the sensor. The amount of this sensor voltage change depends on the slope of the curve at the operating point. The test involves measuring the increase in voltage due to the incremental frequency increase and detecting an out of tolerance value. It is known that external factors which may change the sensors ability to detect a train will also cause a decrease in the slope of the curve. The slope values are monitored and a low reading will cause a fail-safe failure modes.

The present invention eliminates track circuits and the attendant problems and provides a method of measuring train position more accurately through the use of wheel counting sensors and innovative control software to create 'virtual blocks' that need no insulated joints, ignore ballast conductivity and provide train position information in the block.

The objectives of the invention are:

- to provide a fail-safe system in all respects
- to provide a train detection system which eliminates the need for wheel shunting and clean ballast.
- to enhance train position measurement accuracy within a block and improve safety through enhanced collision warning capability.

to eliminate the need for insulated rail joints and provide significant maintenance cost reductions.

BRIEF DESCRIPTION OF THE DRAWINGS

The present invention will be further defined with reference to the accompanying drawings wherein like reference numerals refer to like parts in the several views, and wherein.

DETAILED DESCRIPTION OF THE PREFERRED EMBODIMENT

Figure 5:
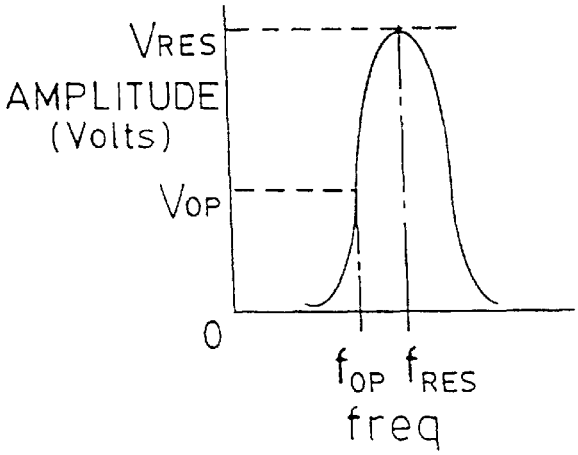
FIG. 5 is a frequency plot for a single coil design.
Figure 6:
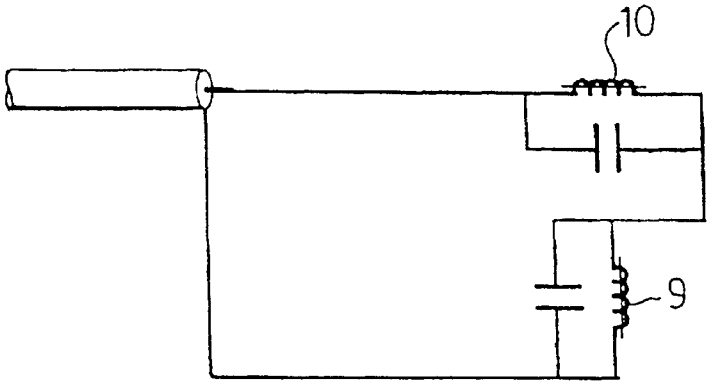
FIG. 6 is a block diagram for a dual sensing element circuit.
Figure 7:
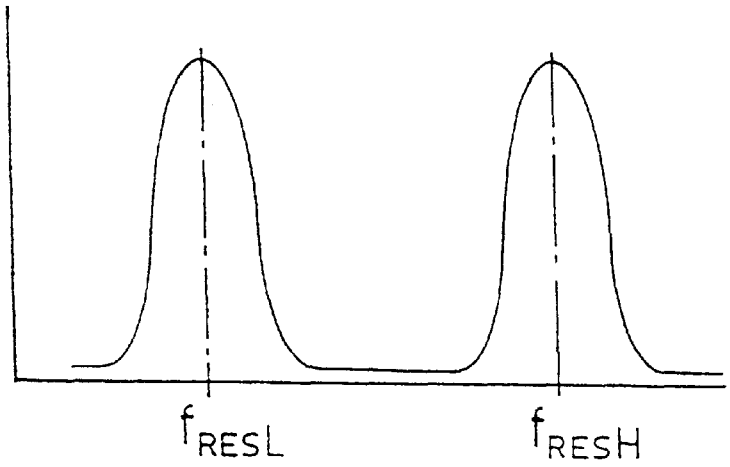
FIG. 7 is a frequency plot for a dual element circuit.

The main horizontally or vertically mounted sensing element is a coil is used to detect a passing wheel. Specifically the wheel flange is used as a target in the preferred embodiment. This is done when some of the magnetic energy is absorbed by the flange and reduces the effective inductance of the coil. This causes a shift in the resonant frequency, Vres, of the coil. The bell shaped curve is shown in FIG. 5 and the operating point of the system is set at or near the midpoint of the curve. This midpoint is determined by the microprocessor controlled frequency drive source that sweeps the coil over a wide frequency range. The entire shape of the bell curve is measured and tested against limit conditions in the software. The correct operating point is then calculated and the sensor is then driven at that frequency This operating point is close to the point of maximum slope of the rising edge of the curve, such that it will produce the maximum voltage change per unit frequency change. A substantial voltage change occurs when the curve is shifted to a higher frequency when a wheel is detected. The voltage change occurs as a change in the peak amplitude of the voltage drop across the sensors. Note that once the operating frequency is not near resonance, the voltage drop goes to zero since the sensor appears as a very low impedance.

The drive circuitry uses a low resistance MOSFET device which derives its signal from a Numerically Controlled Oscillator. In this embodiment, the combination of the DAC and VFC together form the Numerically Controlled Oscillator. The DAC produces an output voltage proportional to the digital values stored into it by the microprocessor. The DAC output drives a Voltage to Frequency Converter (VFC) which produces a square wave output frequency proportional to its input voltage. This square wave signal is presented to the tuned sensor circuit as excitation and will develop a significant voltage across the sensor when very close to its resonant frequency, otherwise there is no detectable voltage drop across the sensor.

The invention also provides for the operation of several sensors in series when they each operate at a minimal frequency separation between them. This allows a single cable to be used to operate multiple sensors and significantly reduces cabling connection and increases the reliability of the system.

The invention provides for a second sensing element or coil mounted in the housing which is positioned to be in close proximity to the web portion of the rail. This coil is also a tank circuit which is in series with the flange coil. In a more basic system a simple contact device could even be used to detect proximity to the rail. Its purpose is to reliably sense the proximity of the rail and report when the sensing element has moved away from the rail by even very small amounts. This coils' oscillations are very heavily damped by the rail and its control algorithm is such that the sensor measures absolute distance between itself and the rail.

Figure 11:
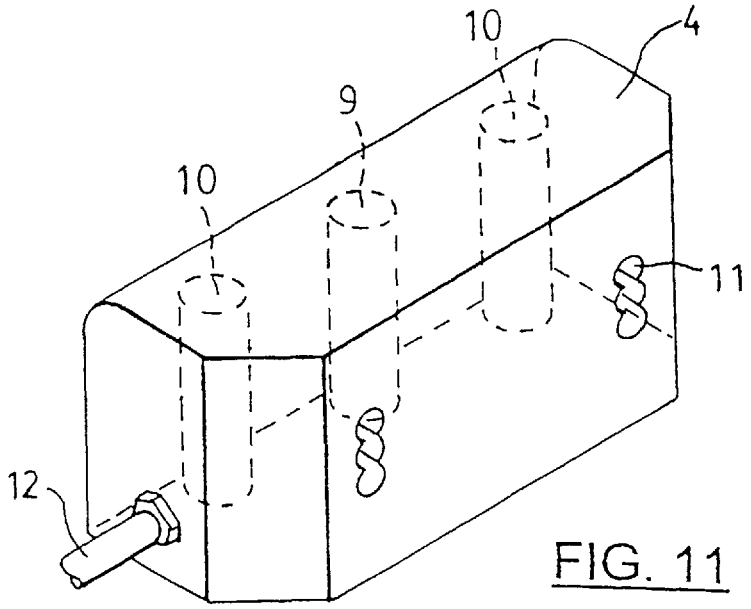
FIG. 11 is perspective view of the housing showing a second orientation of the sensing elements in phantom.
Figure 12:
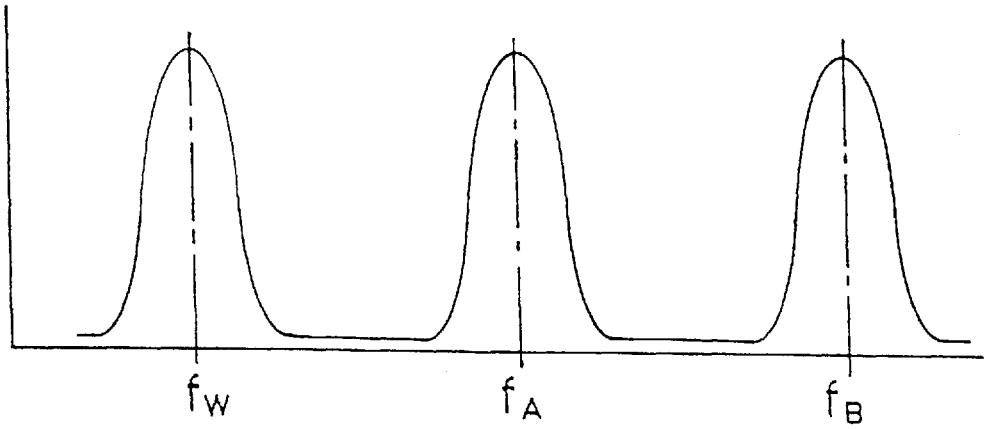
FIG. 12 is a frequency plot for the embodiment of FIG. 11.
Figure 13:
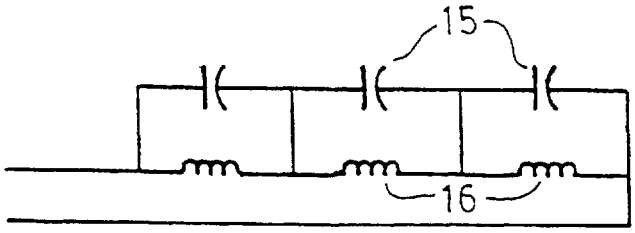
FIG. 13 is a schematic for the three element embodiment contained in a single housing.

The wheel sensing element 10, or flange coil, is positioned to create an elongated magnetic field which extends its detection period when a wheel 1 passed parallel to its axis. Other embodiments use one or more flange coils mounted vertically to sense the wheel via the flange 2, as shown in FIGS. 11–13.

The web sensor itself is an active inductive proximity detector enclosed in a durable housing 14 such as high molecular weight polyethylene. The sensor is designed to be mounted firmly within the web of the rail and measures and detect train wheels by sensing the wheel body or the wheel flanges.

The sensor makes no direct electrical connections of any kind to the rail. All existing rail circuits, both AC and DC are not affected by the operation of the sensor. The sensing element is in a resonant tank circuit and is driven by a current at a frequency proportional to its resonant frequency. An amplitude modulated sinewave output is produced which varies as conductive objects are placed within its field. Each sensor is scanned during recalibration which occurs routinely and as often as every few minutes. The calibration procedure determines and corrects for drift in resonant frequency of sensor and corrects for gain and offset variations due to temperature and aging.

The unit operates by inducing eddy currents into the metal objects in its field and measures the resultant change in impedance of the tank circuit coil.

This signal is rectified and filtered to produce an analog voltage which varies as the inverse square of the target distance from the sensor. This limited sensing distance which falls off rapidly with distance allows full high resolution sensing of a wheel flange, yet completely ignores the presence of fuel tanks, carriages or other unintentional targets that are just a few more inches away.

The output voltage varies according to the distance to the flange and produces a voltage change when a wheel passes over the sensor. The resultant level change looks like a pulse at high wheel speed, and is a DC level shift at zero speed. The pulse amplitude is essentially fixed and the pulse width varies in proportion to the speed of the wheel. Wheel speeds up to approximately 200 MPH or more can be accommodated.

In one embodiment the analog signals are sampled and digitized at about 4000 times per second. The pulses at 60 MPH are about 17 Milliseconds in duration. The digitized pulses are processed by a high speed microprocessor and are corrected for drift and gain errors. The resultant data is then compared to a threshold comparator and duration discriminator which ascertains whether the pulse is a valid wheel event.

In systems requiring only presence detection one sensing element is installed on a rail. In order to determine speed and direction, two sensors are installed along a section of rail. This provides an 8 to 36 inch distance in which to accurately measure the time duration it takes for a single wheel to travel the calibrated distance. The placement of the 2 sensing elements also allows direction to be sensed even at zero speed.

The wheel parameters that can be measured are:

Wheel Counts

Speed

Direction of travel

Flange Height

Wheel counts are tallied at 3 times the actual number of wheels seen by the sensors. This is because each wheel is measured three times in a finite state machine which looks for the correct sequence of signals. Positive wheel counts indicate travel towards the crossing, and negative counts indicate movement away from crossing. Counts are guaranteed accurate regardless of where a wheel stops and reverses on the sensors. Only the net wheel count is accumulated. For example, a train which drives over the sensors, then backs up over the sensors, will show a net wheel count of zero.

Figure 4:
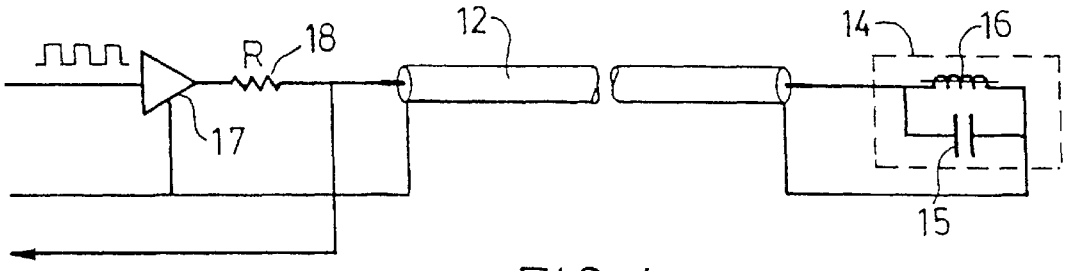
FIG. 4 is a simplified block diagram of a single sensing element circuit.

In one embodiment, the basic sensor structure is represented in schematic-form as shown in FIG. 4. It is comprised of a ferrite-cored coil (16) and shunt capacitor (15) all driven by a square wave source (17) in series with a resistor R1 (18). The tank circuit maintains low impedance until the applied frequency approaches resonance. The impedance increases and reaches a maximum value at resonance and hence develops the maximum sinusoidal voltage drop across it. (see FIG. 5) The initial calibration procedure involves performing a frequency scan of the sensing element, or sensor, to determine its maximum voltage generation and determines the resonant frequency. The electronics system will then pick a point at approximately one-half the peak voltage and operate at that frequency thereafter. The automatic frequency calibration procedure will measure the operating voltage when the sensor is unoccupied and adjust the frequency as required to keep the resultant voltage constant at the selected operating point regardless of aging or temperature drift variations.

The sensor operates by detecting a change in voltage due to a change in its resonant frequency point when the effective inductance of the, coil is decreased by the eddy current losses incurred in the presence of a metal target. The resultant voltage generated will decrease since the frequency is constant while the frequency curve shifts to the right.

The changes in the amplitude of the signal decreases proportionally to the proximity of the wheel flange once the excitation frequency is peak detected. Since the sensor is actively driven, the speed of the passing flange has no effect ie: zero-speed detection of the wheel flange occurs.

The rear sensor resonates at its particular frequency and the maximum amplitude is measured. It is a heavily damped oscillator which will have a marked increase in voltage as the sensor is removed from the dampening effects of the rail. This sensor is used to record the separation and removal of the sensor from the rail. A special detection and calibration algorithm is used to compensate for thermal drift in the sensor coils and electronics at all temperatures encountered.

The first and second sensors resonate at frequencies sufficiently separated such that a single cable or twisted pair can be used to driven both tank circuits in series. When one tank circuit is in resonance, the other is in low impedance mode and does not drop appreciable voltage, and vice-versa. The sensor that is to read need be excited at its resonant frequency and develops the required signal to be read. The other sensor is essentially out of the circuit.

Up to 4 sensors can be multiplexed onto one control system by scanning each one for 4 milliseconds each cycle. After every 4 sensor reads, an auxiliary time slot is used to perform digital and analog self testing on the entire system via closed feedback loops to guarantee proper operation of all electronic components. Any components being out of specification will cause a fail-safe condition.

Figure 1:
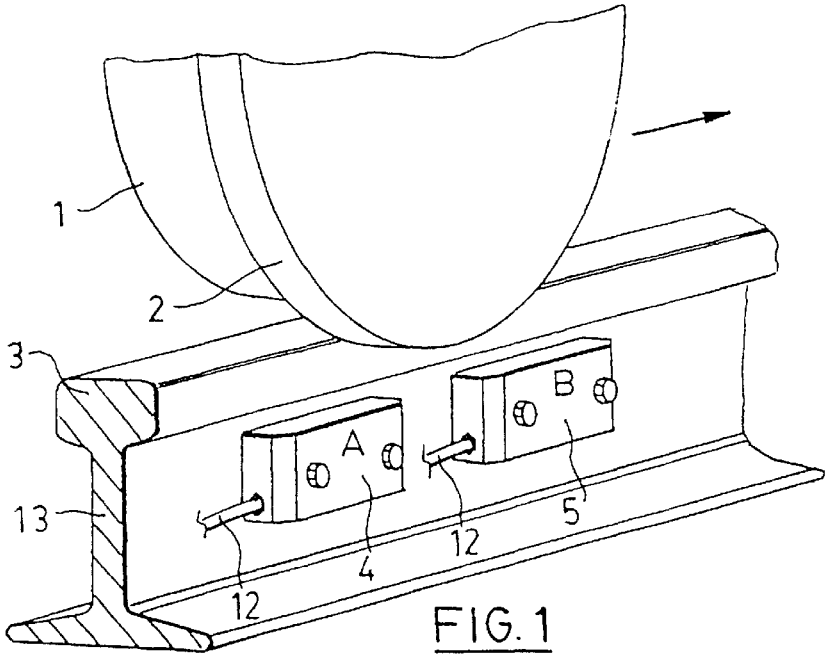
FIG. 1 shows a side view of the wheel counter system installed on a rail.
Figure 2B:
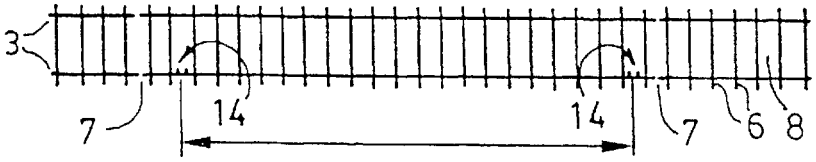
FIG. 2B shows a virtual block defined by the system.
Figure 2A:
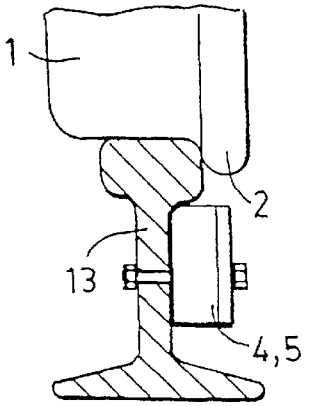
FIG. 2A is a cross-sectional view of an installed wheel counter system.
Figure 2C:
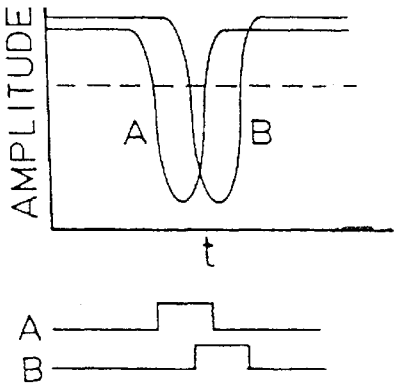
FIG. 2C are graphs showing the amplitude of the detection signals versus time as indicated by two wheel sensing elements.
Figure 3:
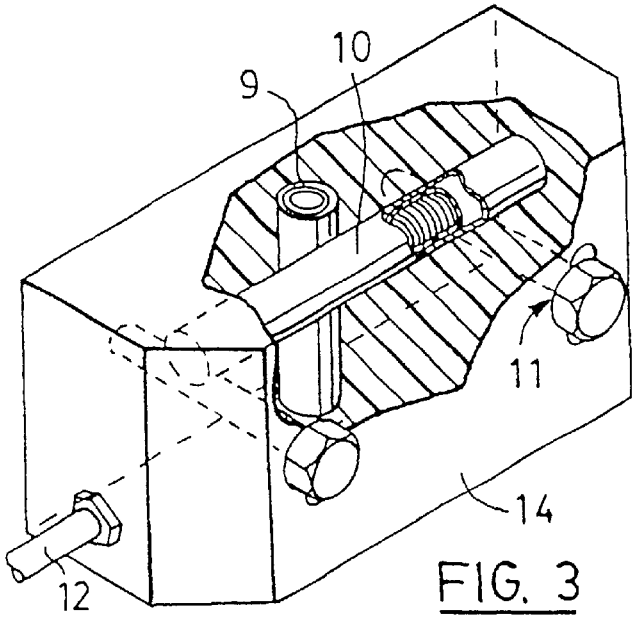
FIG. 3 is a partial section of the housing showing one embodiment of sensing element orientation.
Figure 3A:
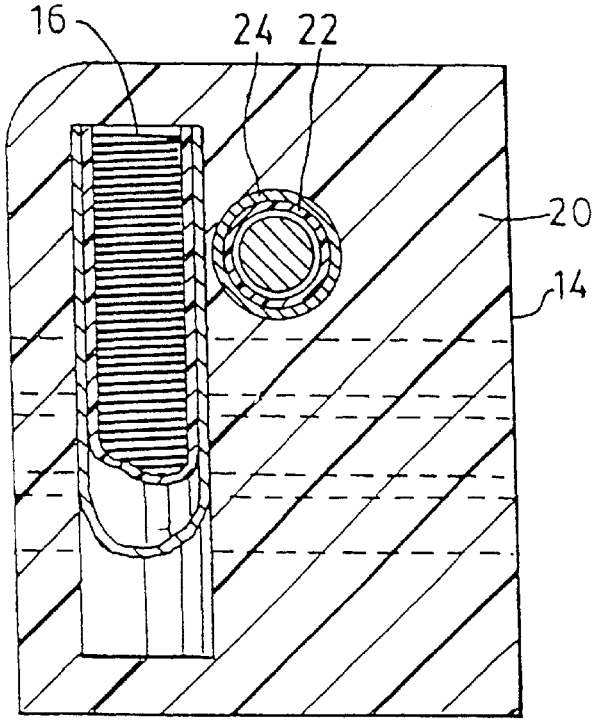
FIG. 3A is a cross-sectional of the detector housing showing sensing elements encased in resilient material.

As shown in FIG. 2C, two sensors in close proximity generate two identical signals, but phase-delayed. The delay period and the critical overlap of the detection zones is used to determine that the wheels are of sufficient size to be considered a valid wheel. Smaller objects such as a dragging chain will not have this simultaneous sensor detection and will not be counted as a wheel.

Finally, sensors placed at each, end of an arbitrary length of track will count wheels in and wheels out of the enclosed area, known as a 'virtual block', or VB. The electronics and software systems determine the net wheel count and the speed and direction of the train movement as well as the progression into the block. The relay outputs of the electronics unit are driven by an isolated transformer-coupled driver circuit which is driven by the executing software. This vital output is used to control gates, signal lights and other devices as required by the application.

Signal Processing Description

This voltage drop across the wheel sensing element, or flange coil, is sensed by a signal processing system located at the drive end of the coaxial cable. The signal is a high frequency signal with amplitude variation dependant upon metal detection in its filed of operation. The signal is subsequently filtered by a low pass filter, which removes any high frequency components. The sensor itself is a high Q bandpass filter so is not sensitive to stray magnetic field frequency components outside of its operating frequency range. As a result, the coil will not pick up any stray interference from passing traction motors on locomotives and will not respond to hand held radios signals operated near the sensors.

The demodulator is a means of converting the high frequency AC signal into a DC level which corresponds to the peak amplitude of the sensed voltage drop across the coil. The signal is then filtered by a low pass filter to remove any high frequency components and noise.

The following stage is a differential instrumentation amplifier which subtracts a constant DC offset from the signal and amplifies the remaining DC level. The DC offset is controlled by the second DAC which is under control of the microprocessor. This DC Offset is automatically adjusted to maintain the desired signal within a certain range for the subsequent multiplexing and A/D converter digitization.

Subsequent to the amplifier, the signal is switched by a multiplexor which routes the signal to a high speed sample and hold circuit followed by the Analog to Digital Converter. A digital value is derived by the A/D converter which is processed in the digital domain from this point on. The multiplexor allows multiple sensors to be switched in and out so that one set of signal processing circuits service all sensors. Separate frequencies and offsets signals are generated in turn for each sensor. The rate of scanning is fast enough to allow all sensors to be visible to the microprocessor at over 2000 times per second so high speed trains can de detected.

Digital processing of the signal includes a digital filter used to stabilize the readings by reducing the noise components. When the sensor is not occupied by a train wheel, the steady state voltage produced is called the baseline value. This baseline value is adjusted by an auto-zero algorithm which keeps the baseline value at its precise value. The baseline value is adjusted by incremental adjustments in frequency achieved by correcting the digital values sent to the Voltage to Frequency converter as well as adjustment of the DC offset voltage at the amplifier. This baseline value can be adjusted over a very wide range and totally compensates for all temperature-induced offsets which occurs in any of the components of the signal processing system. More importantly, for the sake of safety, failure to maintain the baseline signal is detected by the signal processing control program and will cause a fail-safe action to occur, thereby protecting the application.

Included in the digital processing, a digital level detector will detect when a wheel comes into the magnetic field. IN this embodiment, two flange coils are used. They may be separated by up to 36 inches and are positioned such that a wheel rolling through the sensors' fields will activate the first sensor, then both sensors and finally the last sensor alone. This phase of activation determines the direction of travel of the wheel: The time duration between activation of the first sensor to the time of activation of the second sensor is measured by a high speed interval measurement means and its values are used to calculate wheel speed.

The precise phasing and overlap of the two sensors wheel detection is possible only if a wheel of sufficient radius enters the field of both sensors. Smaller wheels, such as those used on a high-rail vehicle will not be detected. Moving the sensors closer together will allow smaller wheels to be sensed and counted if desired.

The invention also provides for sabotage detection in several forms. Firstly, the loss of a high quality signal is detected by the slope test mentioned earlier. An attempts to remove or disable the sensor is immediately detected. Secondly, the sensor is equipped with a second level detector which detected if an object covers more than half of the sensors. This detects if a metal object is rested on the sensor or if metallic debris falls on the sensor and creates a signal in excess of what a flange would normally provide. Generally, a flange will pass the sensors with a sufficient clearance such that direct contact with the sensor is avoided. Direct contact is assumed to be an error condition and the system will fail safe.

Self Test Description

The invention further provides for the detection of faults in the signal processor and sensor circuitry by creating closed loop feedback paths from every major component such that diagnostic tests are performed continually on individual component parts of the circuitry. One diagnostic time slot is used for every 4 measurements time slots to provide a continual monitoring function which occurs at a rate of over 30 per second. These self diagnostics will immediately detect both gross and subtle deviations in the operation and parameters of the system.

One such test, the slope test, actually involves the sensor in the closed loop feedback path and performed a complete[]test of the operability of the sensor. The entire system utilizes an electronic control board and provides a complete signalling and train detection system with the vital characteristics and features as discussed above.

In one typical installation, a wheel count sensor processor (WCS) drives 4 sets of track-mounted wheel sensors and provides a serial digital output indicating speed, direction and wheel count. These outputs are used to detect train motion and direction of travel over the sensor point. This information is usually sent back to an Application processor or a Supervisory system which makes use of the data. The Sensor Processor board is an intelligent subsystem which keeps the sensors calibrated and ready for any wheel passage. The closed loop control compensates for thermal drift, component aging and track wear. FIG. 11 shows a block diagram of the sensor processor.

When wheel counters are placed on track with a separation, a Virtual Block is created which produces a net wheel count value. Net wheel count is calculated in the application processor which reads out the wheel counts from each Wheel Count System (WCS). The net wheel count is calculated by taking the wheels-in minus wheels-out of each virtual block. Any non-zero value indicates that the block is occupied and the sign of the value indicates direction. These virtual blocks require no insulated joints to create and can be anywhere from a few feet to several miles long.

Figure 10:
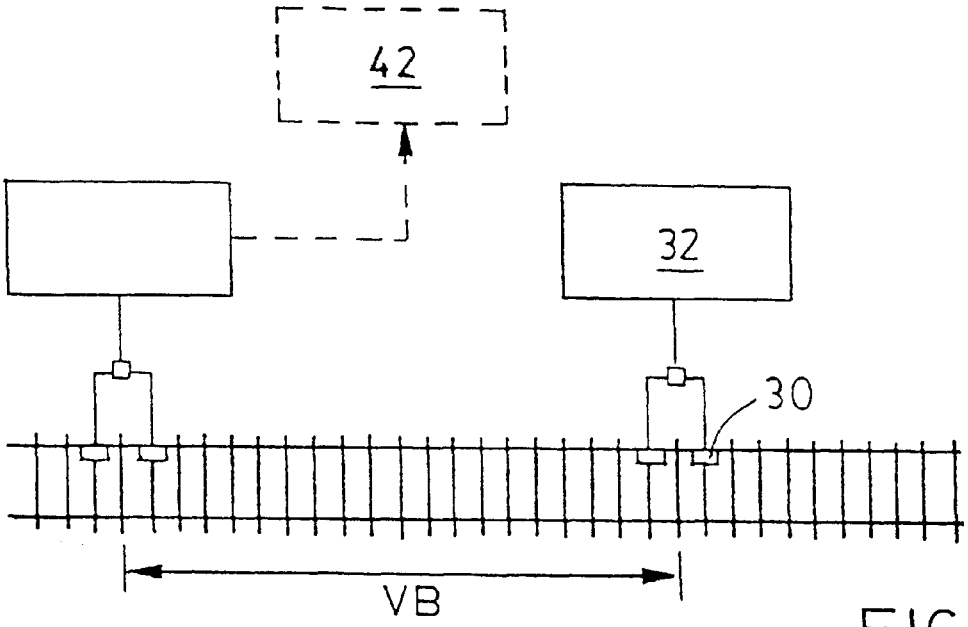
FIG. 10 shows a virtual block created by two wheel count processors and two pairs of sensors.

FIG. 10 depicts a virtual block created by two WCS processors and two sets of Web sensors. Each WCS processor can handle 4 sensor pairs.

Theory of Operation

Every parallel resonance RLC circuit exhibits an anti-resonant frequency whereby the impedance of the circuit is at its maximum value. The impedance of this circuit depends on the resistance of the wire used in the construction of the inductor and capacitor as well as coupled-in losses from the magnetic core and surrounding metallic objects. In the case of the rail web sensor, losses resulting from the proximity of the steel rail creates a loss factor which is calibrated into the sensor system. (In fact, if the sensor becomes loose or falls away from the rail, this will remove the anticipated loss factor and triggers a fail-safe alarm condition)

Each sensor has its own distinct resonance frequency which will vary with time and temperature. Magnetic circuits of the core have been stabilized and stable capacitors have been used in the tank circuit, but no attempts are made to try and control drift in sensor characteristics. Instead changes in the sensor characteristics are tracked by incorporating a closed-loop system using feedback which compensates for sensor changes. The microprocessor digitizes the sensor outputs, makes corrective changes in the frequency and offset and readjusts the driver circuits to keep the sensors in a balanced situation. Failure to keep all sensors balanced will result in a fail-safe condition.

Time Division Multiplexing (TDM)

All 8 sensors signals are sequentially read through an analog multiplexor and digitized. All 8 sensors therefore take just 3.2 Milliseconds to scan. At this rate, a train will travel about 3.0 inches at 60 MPH.

The use of TDM allows a more simple hardware implementation and reduces the number of parts dramatically. This is because just one A/D converter and one set of drive and calibration circuitry is shared between all sensors.

System Calibration and Drift Cancellation

The sensor output is an amplitude modulated 100 KHz signal which is rectified and filtered to produce the desired baseline signal. The baseline signal is the signal which is produced when no trains are detected. This signal has a considerable DC component which is remove by a differential amplifier with the offset controlled by a 12 bit Digital to Analog Converter (DAC). Since each sensor has a different offset and operating frequency, the microprocessor will supply the DAC and the (Numerically Controlled Oscillator) NCO with the corresponding offset and frequency values determined during calibration for that sensor. The determination of the operating point on the resonant curve and the determination of the offset cancellation voltage is done during system calibration.

Two types of sensor calibration are perform during system operation: These are:

System Recalibration: This is a complete re-acquisition of all NCO and OFFSET values used to control the sensors. This is a major recalibration which is performed every few minutes. Calibration values are checked and verified before system operation can resume. A failure to calibrate a sensor will result in a fault assertion.

Auto-Zero: The auto-zero circuit is active at all times except when motion is detected at the sensors. (This is so we do not attempt to correct drift while a train is passing). This baseline signal may drift slowly and the Auto-zero software will make small adjustments in the calibration values to keep the baseline at its normal balanced value.

Compensation for Thermal Drift

The sensors often operate in a −60 deg C. to +80 deg C. range, which is a substantial temperature differential. Induced drift due to temperature is removed by an auto-zero circuit algorithm. If drift occurs, this baseline shift will be corrected by the Auto-zero circuits by compensating the offset voltage sent to the Differential Amplifier. Auto-zero will correct for slow drift over a limited range of values. Large and sudden corrections are not required since the thermal time-constants are quite large. Any rapid shift in the baseline value which produces a reading which falls outside the accommodation range of the Auto-zero function range and exceeds the rate of compensation will cause a calibration fault assertion.

Long Term Aging

As components age, electrical characteristics also change. These rather slow changes will be corrected by the recalibration procedure which runs every few minutes. Again, sudden changes in system calibration values indicates a problem and will cause a fault assertion.

Vibration Modulation of the Sensor Output

The sensors respond to the presence of metal within their magnetic field. Excess shock and vibration cause the sensor housing to vibrate with respect to the rail and cause a slight modulation of the sensor output. The design of the housing and the rigid mounting keeps this noise to less than 1% of the signal output.

Transducer Quality Factor

The Q of the transducer tank circuit is measured at each calibration, and can be downloaded to a diagnostic computer if this reporting is enabled. This will permit the plotting of the frequency response and verification of the Quality factor 9Q) of the circuit.

The Q measurement is an ideal way of performing a functional test of the sensor, since all electrical magnetic and mechanical factors must be within tight control for the Q to register properly. Changes to the Q of the circuit which are detected may be caused by any of the following factors:

coil has shorted turns
capacitor leads broken
coil leads broken
cold solder joints
loose crimps on wires
metal fatigue or work-hardened connections
cable resistance changes
water fouled coaxial cable
high resistance in connectors
cracked ferrite cores
cores moved in position introducing air gaps
sensor moving away from rail
connection bolt removed from senior
sensor sabotage
metallic debris on sensor
excessive ferrous ballast on sensor These factors cause the calibration frequency and offset to change also as the closed-loop control and calibration system attempts to compensate. These corrective actions are used to trigger a log message if a minor change occurs or cause a fail-safe action if a major out-of-tolerance correction is attempted.

Data logging of the Q of the system sensors at each calibration provide a method of assessment of the long term durability and repeatability of the sensors.

Wheel Flange, Ballast and Rail Effects

The Q of the coil is a carefully monitored and controlled sensor calibration parameter, since it encompasses not only the sensor electrical and mechanical factors, but it also includes the magnetic circuit of the rail which supports it.

With a passing wheel flange, energy from the magnetic field is lost in the wheel through the induction of eddy currents into the wheel. This is the eddy current losses as discussed previously. Another more commonly understood effect is the ferrous effect which occurs when a ferrous material is placed in the magnetic circuit. The ferrous effects increase the magnetic field strength by increasing the overall permeability of the magnetic circuit.

The circuit does not look for the measurable ferrous effects in the wheels. The use of a high frequency field creates large eddy current losses and reduces the ferrous effects. The reasons for this are as follows:

The eddy current detection method will detect wheels made of steel, steel alloys, and also any other conductive non-ferrous material, such as brass, titanium, magnesium or aluminum alloys. The resultant detection is not affected by the percentage of iron in the wheel alloys, but rather by the conductivity of the wheel which is fairly constant in all wheel types.

The ferrous effect of the adjacent steel rail is minimized at 100 KHZ so it does not 'swamp' the sensor magnetically.

The Ferrous compounds in the slag used as ballast has low permeability at 100 KHZ and provide low electrical conductivity to eddy currents. This makes it possible to discriminate a steel flange, which causes a large dip in output voltage from a stray hunk of ballast which causes a slight increase in output voltage. The proximity of magnetic ballast on a magnetic sensor is mitigated by this technique.

The WCS Processor Board

Figure 8:
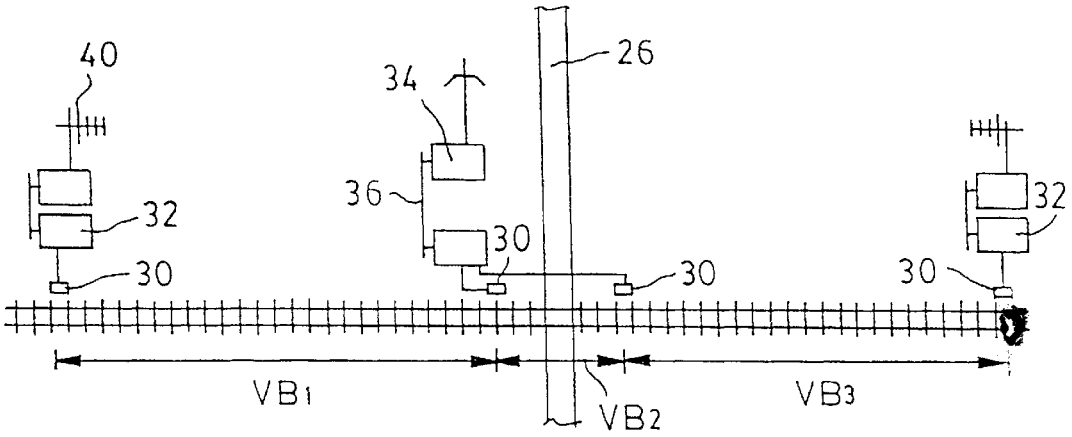
FIG. 8 is a simple 3-block crossing configuration using the wheel counting system.

The Wheel Count Sensor Processor is a standalone module which is used to detect, count and report on train wheels, speed direction. The WCS processor has a dedicated embedded micro-controller which is used to execute the boards primary data collection, calibration and control function. In addition, the board contains a LONTALK network processor which is used to communicate over a variety of transmission media. The block diagram of the sensor processor is shown in FIG. 8.

The Sensor Processor is housed in a compact weatherproof box which is mounted in a wayside cabinet and pole mounted. The system takes sensor data from the Web Sensor, digitizes the analog values, processes it and communicates back to the crossing processor.

Microprocessor

The heart of the system is the CMOS RISC Micro controller unit which runs the entire system. The microprocessor interfaces directly with the network processor communications sub-system which handles all of the communications with other members of the system. All vital circuits are on the main board under dedicated micro controller control. An embedded micro-controller was chosen to do the CPU functions because most of the hardware could be integrated on a single low power chip. This includes all of the analog A/D, EROM, CPU, watchdog timers, interrupt timers, system register memory and all I/O functions.

Three means of detection of faulty sensor operation are provided in the sensor processor fault detection logic:

If for any reason, a sensor fails to execute the proper sequence of states while several wheel transitions have been detected by either sensor, the sensor processor will activate a fault signal to the application processor.

The wheel counts are always in multiples of 3 since each wheel transition causes a count. If the final count of all the wheels across a sensor pair are not a multiple of 3, the sensor processor will report a sensor fault. All All Sensors are in a feedback control loop whereby balance is maintained within closely scrutinized limits. Any defects are reflected immediately by changes in the calibration parameters and/or sensor baseline balance points.

Non Volatile RAM

This is memory which has R/W access and is used to store system setup, configuration and PN code sequences for communications encoding and decoding. The memory is held active by a small battery which keeps the chip alive permanently. NVRAM is used to provide data logging of observations.

Diagnostic Computer Software

Manual sensor functionality and sensitivity measurement testing is done to assure that the sensitivity and range of the sensor is optimum. Using a PC equipped with the diagnostic software, the sensor outputs are presented on the screen. A test object can be placed manually on each sensor while the digital value is watched. Both sensors must show the correct deviation for the test :object, and must change by equivalent amounts in order to pass.

Sensor Processor Built-in Digital Storage Scope

It is impractical to have a technician go on-site and place a scope on an analog waveform and wait for a critical event to occur. However, this capability is built into the Sensor Processor and is an invaluable tool for diagnostics and system testing. The entire health of the overall sensor and sensor processor system can be analyzed by a detailed trace of the signal waveforms as a train passes over the wheels.

Similarly with the analog sensors system, the following parameters can be determined from a waveform diagnostic:

Wheel flange height

Wheel speed and spacing

Sensor mechanical integrity (is sensor secure)

Phase relationships between sensors of the pair

A/D conversion accuracy (is it monotonic and operating in the correct range mechanical vibration induced into the sensors Cable noise and sensor noise pickup Broken or defective sensors—by monitoring signal amplitude, noise and pulse width repeatability of the signal Sensor sensitivity and effective gain The sensor processor has the capability to collect and transmit this data at the 4 kHz rate and does not analyze or store the data locally. All readings from a specific channel are transmitted by the sensor processor to the diagnostic computer. The receiving diagnostic computer program reads in the data and stores it into a file for immediate recall.

The actual waveform, its shape and magnitude can be viewed and verified. Also, background noise and any transients can be identified indicating a malfunctioning sensor. This will identify the mechanical aspects of the sensors under real vibration and train load and can identify a noisy sensor which might otherwise pass the static sensitivity test.

Noisy sensors can cause false threshold crossings and provide incorrect wheel counts. However, in our tests, noisy sensors always detected the presence of a train. Sensor noise is due to mechanical movement of the sensor with respect to the rail.

This built-in dual channel digital storage scope is a powerful tool to illustrate wheel impact when the normal proximity transducer is replaced with a vibration detection sensor. In this case, rail vibrations caused by nearby bad joints and flat wheels can be detected. This vibration data can be examined in real-time by suitable software analysis programs and correlated to the actual wheel count on the train.

Note that all gathered files can be saved and played back at any time on the diagnostic computer. This allows us to gather information periodically and compare the vibration profiles of the rail. This may help to diagnose rail, ballast and sensor changes over time.

The application processor which reads the data block from the Sensor Processors will process the data according to its specific requirements. For the crossing application, the raw data includes wheel counts from each station which are processed into block occupancy counts and train direction by the crossing processor and used to create the warning alarms.

Fail-Safe Verification Techniques

System level Vitality checking is done in the NCC communication processor which also acts as the main application processor 42. The NCC processor collects all data from the remote processors and can make several very easy and quick determinations as to the status of the entire system.

- Wheel counts from all WCS systems match and are multiples of 3
- Net block counts are all zero when a train leaves a block
- All analog voltages from each sensor are in balance and in control.
- Noise levels from the sensors must be stable and the motion detector's bits must remain off.
- Each processor sends a byte to the crossing indicating which sensors are active if an essential sensor is inactive, a fail-safe alarm is activated.
- All stations must be reporting in or a timeout occurs and the crossing alarms go on.
- Overall system wheel count integrity is self-checked by comparison of the wheel counts from all four reporting sensor stations. If any station reports a wheel count different than that of the majority, a fail-safe condition is entered. Since all stations use totally independent hardware to measure wheel counts, there is no chance of interaction between them. When wheel counts agree from all sensors, it is good assurance that everything is normal. The chance that all have made the same counting error is remote, and even if it does occur, the crossing will still function perfectly, but will think it was just a slightly shorter train.
- The Block control outputs are derived by calculation of the wheels-in and wheels-out of any given block. If these do not match after a train passes through, then the net block count will not be zero. Blocks can be configured to generate an alarm depending on the sign of the net wheel count. A positive wheel count is indicative of a train approaching the crossing, whereas a negative wheel count is an outgoing train. Alarms are generally cleared when all inbound and outbound block counts surrounding the crossing itself are zero net.

Sample Applications

Both simple and sophisticated grade crossing systems can be built using the present invention. The system is designed in modules with all modules capable of being interconnected by a high speed network based on an industry standard such as Echelon's LonTalk Protocol. The network can run over several mediums, including twisted pair cable, fibre-optic cable, and wireless spread spectrum radio link.

EXAMPLE 1

Simple Crossing

FIG. 8 shows a simple 3 block crossing system, VB1, VB2 and VB3. The Wheel Count System (WCS) 32 processors control and sample the wheel sensors and deliver the resultant data to their respective NCC Communications Processor 34 via a direct twisted pair running the LonTalk Protocol 36.

Communications from the FarPoint Wheel counters to the crossing NCC Processor is via a wireless spread spectrum radio system 40. This wireless link allows the FarPoint processors to be placed out anywhere up to approximately 5–6 miles. The NCC module at the crossing runs the crossing application programs and wireless communications.

For basic crossing applications, the wheel counting system is used to determine wheel counts into and out of a control zone, called a virtual block, VB.

Features provided by such a crossing are:

- Does not require electrical connection to the track so is immune to water, salt, rusty rail, poor shunts, lightning surges and shorted rails.
- Breaks the 4000 ft limit of most track circuits. With radio control, can go out 5–6 miles.
- Crossing rated up to at least. 150 MPH and can maintain 30 second constant warning time.
- Can eliminate insulated joints.
- Does not require bonded rail.
- Low calibration and maintenance.
- System is self calibrating and self-verifying.
- Crossing boundaries can overlap without problems ie: several overlapping crossings can be implemented without interaction. However, sharing of wheel count stations between two crossings can reduce overall cost.
- Block net wheel count data serves to provide train position, direction and speed deterministically and allows differentiation of a track short from a train. All crossings generate virtual block wheel counts which is readable over the network.
- Built in modem interface for remote monitoring of crossing and support systems.
- PC laptop resident tools, such as digital scope trace and calibration log files allow easy maintenance and diagnostics
- Fail-safe and Vital approved.
- All modules support RS232 and RS485 ports for standalone operation and integration into other vendors' systems. The RS232 serial port can interface to a wireless modem or external computer. Port can be switched to talk to the sensor processor for analog system diagnostics, or to the LONWORKS Chip for network configuration and communications.
- Industry Standard LonTalk compatible interface for wide area networking. LonTalk provides for interoperability with other vendors equipment. LonTalk operates over several mediums, such as power lines, radio, track circuits etc.
- Communication processor board allows connection to high speed fibre-optic networks with industry standard protocols such as HDLC, LonTalk, BiSync, and many more.
- NCC processors support wireless and wired network segments. Will operate over micro-wave links or satellite communications.
- Crossing can support communications with mobile communication protocol (MCP) equipment units for safety advanced warning collision avoidance and locomotive communications.
- All crossings have a permissive output, alarm output and traffic pre-emption relay outputs.
- Can overlay existing crossing systems and track circuits without affecting them.

Diagnostics operate while system in normal sensing operations to provide on-line diagnostic capability without the risk of affecting crossing protection.

Train activity data log can be read out on demand through diagnostic interface computer. Data can be used by application processor to create detailed reports.

Board supports LED's for verification of operation and system diagnostics.

Wide temperature range of approximately −40 to +75 Deg C. in a NEMA 4 enclosure. No vents or fans required. Does not require a heated bungalow to operate.

Intelligent integrated Power Management functions operates with optional solar panels in locations where there is no AC power. Low power design and low power Protocols allow small battery sizes and small panels.

Vital I/O System can operate switches, lamps, gates and read vital inputs. Ideal for block control, code-lines etc.

The motion sensor system is shown in FIG. 8.

EXAMPLE 2

Predictive Advanced Warning Systems

Sensors at remote sites report on train speed, train direction and wheel count. The crossing processor receives input from all sensor processors and calculates the time of arrival based on the measured speed. After the required delay, the alarm is sounded at the appropriate time to provide the constant warning time (typically about 22 seconds). Sensors can be placed as far out as 5 miles on each side, and placed as often as desired. Closer spacing provides less 'dark territory' and reduces the error in calculated warning time caused by accelerating or decelerating trains after they pass the speed detectors. accuracy approaching that of the industry standard predictive advanced warning systems to be achieved at a very modest cost.

Figure 9:
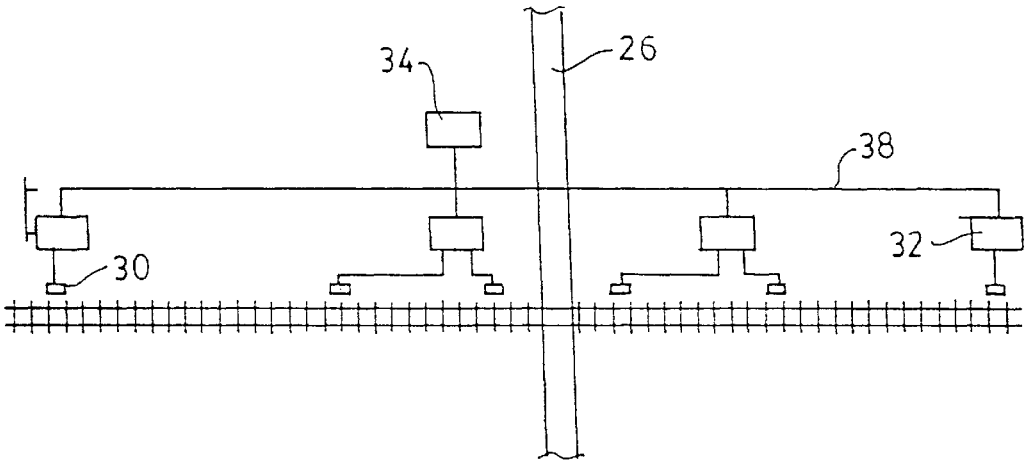
FIG. 9 is a 5-block crossing using power lines to carry data.

This type of crossing is shown in FIG. 9 with AC power lines 38 used to power the sensors and to carry data.

It will be appreciated that the above description related to the preferred embodiments by way of example only. Many variations on the invention will be obvious to those knowledgeable in the field, and such obvious variations are within the scope of the invention as described and claimed, whether or not expressly described.

What is claimed is:

1. A railway vehicle detector for sensing a passing railway vehicle wheel travelling along an elongated rail connectable to a processing means, said detector comprising:

a. means for supplying an alternating current having a preselected frequency;

b. at least one wheel sensing element, including a resonant tank circuit having a resonant frequency, excitable by said alternating current, said tank circuit being arranged for producing a voltage change as said wheel is travelling adjacent said at least one wheel sensing element due to a change in the effective inductance in said tank circuit as the wheel passes;

c. the at least one wheel sensing element being connectable to the processing means for receiving said voltage change and responsively producing an output signal indicative of the presence of said wheel, wherein said preselected frequency is proportional to the resonant frequency of the tank circuit, and further wherein said preselected frequency is the frequency required to operate the tank circuit at a voltage approximately equal to a range between one half of the voltage across the tank circuit when operated at the circuit's resonant frequency and the voltage across the tank circuit when operated at the circuit's resonant frequency.

2. A railway vehicle detector as described in claim 1, wherein said preselected frequency is the frequency required to operate the tank circuit at a voltage approximately equal to one half of the voltage across the tank circuit when operated at the circuit's resonant frequency.

3. A railway vehicle detector as described in claim 1, further comprising a rail sensing element configured to indicate the proximity of said detector to said rail being greater than a preselected distance.

4. A railway vehicle detector as described in claim 3, wherein said preselected distance is 2 inches.

5. A railway vehicle detector as described in claim 3, wherein said rail sensing element comprises a resonant tank circuit.

6. A railway vehicle detector as described in claim 5, wherein the resonant tank circuit of the rail sensing element is arranged for producing a voltage change as said detector is moved in relation to said rail, and further being connectable to a processing means for receiving said voltage changes and responsively producing an output signal indicative of the proximity of said detector to said rail within a preselected range.

7. A railway wheel vehicle detector as described in claim 1, wherein said resonant tank circuit of said at least one wheel sensing element is connected in a multiple terminal electrical network comprised of;

a. a primary coil connected between a first and second network terminal; and b. a capacitor connected between the first and second network terminal.

8. A railway vehicle detector as described in claim 1, wherein the at least one wheel sensing element is a first wheel sensing element and further comprising a second wheel sensing element in longitudinal spaced relation to the first wheel sensing element, each being connectable to the processing means for receiving the voltage changes from the circuit of each wheel sensing element and responsively producing an output signal indicative of the presence, speed, direction and wheel count of said wheel.

9. A railway wheel vehicle detector as described in claim 8 wherein the tank circuit of the first and second wheel sensing elements are in turn series connected in a multiple terminal electrical network comprised of;

a. a first coil connected between a first and second network terminal;

b. a first capacitor connected across the first and second network terminal;

c. a second coil across the second and a third network terminal; and d. a second capacitor across the second and third network terminal;

and wherein the first coil and the first capacitor comprise said resonant tank circuit of said first wheel sensing element and the second coil and the second capacitor comprise said resonant tank circuit of said second wheel sensing element.

10. A railway vehicle detector as described in claim 3, wherein the wheel sensing element is positioned to detect the movement of said wheel along the elongated rail and wherein the rail sensing element is positioned to indicated the proximity to said rail such that both the wheel and the rail are sensed independently and without interaction.

11. A railway vehicle detector as described in claim 9, wherein excitation by said alternating current will produce a steady state voltage drop across the said network at the preselected frequency of each excited tank circuit without appreciable voltage generated across the other tank circuit not in resonance such that each circuit can be separately excited and sensed without interaction from the circuit.

12. A railway vehicle detector as described in claim 9, wherein the first and second wheel sensing elements are mounted on said elongated rail and produce various said voltage fluctuations when said wheel is travelling in a forward direction and a second variation pattern when said wheel is travelling in a reverse direction.

13. A railway vehicle detector as described in claim 8, wherein the longitudinal displacement between the first and second wheel sensing elements is in a range of 8 to 36 inches.

14. A railway vehicle detector as described in claims 13, wherein the longitudinal displacement is generally 12 inches.

15. A railway vehicle detector as described in claim 1, wherein said means for supplying an alternating current is a Numerically Controlled Oscillator.

16. A railway vehicle detector as described in claim 1, wherein said processing means includes digital and analog processing such that calibration is automatic and adjustment free over an extended temperature range and life of the detector.

17. A railway vehicle detector as described in claim 1, wherein said processing means includes digital and analog processing such that components are configurable in a plurality of separate closed loop feedback paths thereby providing a means for feedback loop self-testing.

18. A railway vehicle detector as described in claim 17, wherein said processing means includes an amplifier for removal of a DC offset and amplification of steady state voltage fluctuations caused by said wheel.

19. A railway vehicle detector as described in claim 8, wherein said processing means includes level detection for detecting said wheel adjacent said first wheel sensing element and for detecting said wheel adjacent the second wheel sensing element.

20. A railway vehicle detector as described in claim 19, wherein said processing means includes a level detector for producing a logic output when said first or second wheel sensing elements produce signal patterns indicating metallic objects other than said wheel.

21. A railway vehicle detector as described in claim 20, wherein logic circuits produce a first output signal indicating forward movement of said wheel and a second output signal indicating movement of said wheel in a reverse direction, thereby detecting a direction.

22. A railway vehicle detector as described in claim 21 wherein said logic circuits differentiate forward and reverse movement of said wheel along said elongated rail such that wheel detection and the direction determination is accurate during any dead slow wheel reversal over the detector.

23. A railway vehicle detector as described in claim 22, wherein said logic circuits produce output signals in the form of a numerical output corresponding to a number of wheels passed by the detector.

24. A railway vehicle detector as described in claim 23, wherein said logic circuits produce output signals such that any and all deviations from normal operation will cause a fail-safe output action.

* * * * *